US009831609B2

(12) United States Patent
Aizawa et al.

(10) Patent No.: US 9,831,609 B2
(45) Date of Patent: Nov. 28, 2017

(54) ELECTRICAL CONNECTOR AND ELECTRICAL CONTACTS CONFIGURED TO CONTROL IMPEDANCE

(71) Applicants: Tyco Electronics Corporation, Berwyn, PA (US); TYCO ELECTRONICS JAPAN G.K., Kawasaki-shi (JP)

(72) Inventors: Masayuki Aizawa, Machida (JP); Chad William Morgan, Carneys Point, NJ (US)

(73) Assignees: TE CONNECTIVITY CORPORATION, Berwyn, PA (US); TYCO ELECTRONICS JAPAN G.K., Kawasaki-Shi (JP)

( * ) Notice: Subject to any disclaimer, the term of this patent is extended or adjusted under 35 U.S.C. 154(b) by 0 days.

(21) Appl. No.: 14/834,592

(22) Filed: Aug. 25, 2015

(65) Prior Publication Data

US 2017/0062989 A1 Mar. 2, 2017

(51) Int. Cl.
*H01R 13/02* (2006.01)
*H01R 13/6473* (2011.01)

(52) U.S. Cl.
CPC ..... *H01R 13/6473* (2013.01)

(58) Field of Classification Search
CPC ..... H01R 13/53; H01R 13/6485; H01R 13/6666; H01R 13/03; H01R 43/16; H01R 23/7073
USPC ..... 439/181, 660, 886
See application file for complete search history.

(56) References Cited

U.S. PATENT DOCUMENTS 5,090,116 A * 2/1992 Henschen ..... B23K 3/0475 29/827
5,288,959 A * 2/1994 Henschen ..... H05B 6/105 219/615
5,357,084 A * 10/1994 McKee ..... H05B 6/105 174/88 R
5,605,477 A * 2/1997 Wu ..... H05K 1/0233 439/620.24
6,347,962 B1 * 2/2002 Kline ..... H01R 13/6587 439/181
7,011,556 B2 * 3/2006 Miyazawa ..... H01R 13/035 439/67

* cited by examiner

*Primary Examiner* — Hien Vu

(57) ABSTRACT

Electrical connector includes a connector body and a plurality of electrical contacts coupled to the connector body. Each of the electrical contacts has an elongated body that includes a base material and an impedance-control material plated over the base material. The impedance-control material extends along only a designated portion of the elongated body. The impedance-control material has a relative magnetic permeability that is greater than a relative magnetic permeability of the base material. The impedance-control material increasing an impedance of the electrical contact along the designated portion.

20 Claims, 8 Drawing Sheets

ELECTRICAL CONNECTOR AND ELECTRICAL CONTACTS CONFIGURED TO CONTROL IMPEDANCE

BACKGROUND

The subject matter herein relates generally to electrical connectors that have electrical contacts configured to convey data signals.

Communication systems exist today that utilize electrical connectors to transmit data. For example, network systems, servers, data centers, and the like may use numerous electrical connectors to interconnect the various devices of the communication system. An electrical connector may be, for example, a pluggable connector that is configured to be inserted into a receptacle assembly. The pluggable connector includes signal contacts and ground contacts in which the signal contacts convey data signals and the ground contacts control impedance and reduce crosstalk between the signal contacts. In differential signaling applications, the signal contacts are arranged in signal pairs for carrying the data signals. Each signal pair may be separated from an adjacent signal pair by one or more ground contacts.

It is generally desirable to match impedance through a communication pathway in order to minimize return loss and maintain signal integrity. Existing electrical connectors, such as high-speed connectors, may have areas with relatively low impedance. These areas often occur at the mating interface between the electrical contacts of two different connectors. Known methods for increasing impedance at the mating interface include decreasing the size of the signal contacts, increasing the spacing between signal contacts, and inserting a lower dielectric constant material, such as air, between the signal contacts. However, it may not be possible or practical to implement one or more of these methods due to costs, manufacturing tolerances, or other requirements. For example, it is often necessary for the signal contacts to have predetermined locations relative to one another and/or for the signal contacts to have a designated contact density.

Accordingly, there is a need for alternative methods of controlling impedance at the mating interface between two electrical contacts.

BRIEF DESCRIPTION

In an embodiment, an electrical connector is provided that includes a connector body and a plurality of electrical contacts coupled to the connector body. Each of the electrical contacts has an elongated body that includes a base material and an impedance-control material plated over the base material. The impedance-control material extends along only a designated portion of the elongated body. The impedance-control material has a relative magnetic permeability that is greater than a relative magnetic permeability of the base material. The impedance-control material increases the impedance of the electrical contact along the designated portion.

In an embodiment, an electrical contact is provided that includes an elongated body having a base material and an impedance-control material plated over the base material. The impedance-control material extends along only a designated portion of the elongated body. The impedance-control material has a relative magnetic permeability that is greater than a relative magnetic permeability of the base material. The impedance-control material increases an impedance of the electrical contact along the designated portion.

In an embodiment, an electrical contact is provided that includes an elongated body having a base material, a barrier material that is plated over the base material, and a precious metal material that is plated over the barrier material for only a portion of the elongated body. The precious metal material extends along a mating segment of the elongated body that is configured to engage a corresponding contact of a mating connector. The base material has a relative magnetic permeability that is greater than a relative magnetic permeability of the barrier material. The base material increases an impedance of the electrical contact along the mating segment.

DETAILED DESCRIPTION

Figure 1:
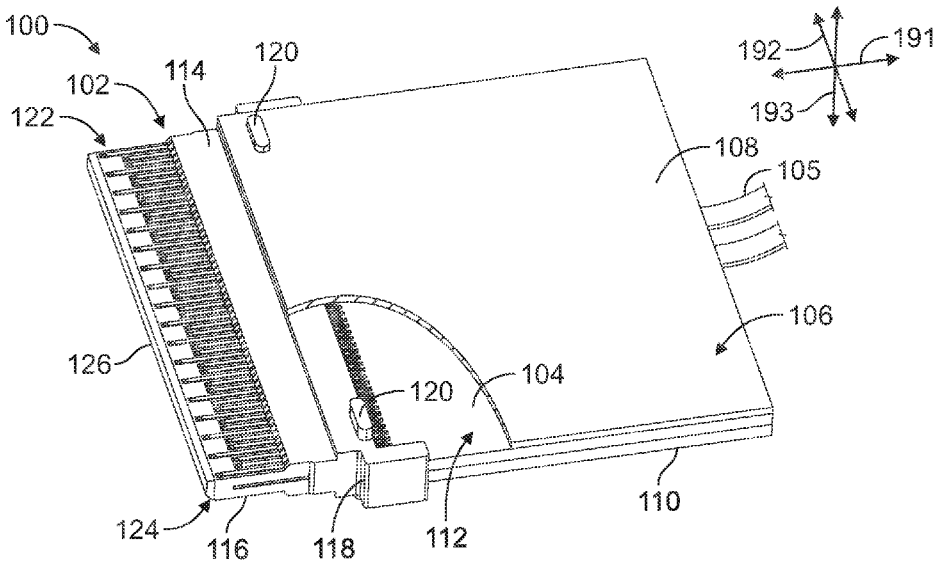
FIG. 1 is a perspective view of a pluggable cable assembly that includes a pluggable connector formed in accordance with an embodiment.

Embodiments set forth herein include electrical contacts that are modified to control impedance and electrical connectors including the same. The electrical connectors are configured to mate with other electrical connectors, which are hereinafter referred to as mating connectors, through a mating operation. During the mating operation, each electrical contact of one connector may engage and slide along a respective electrical contact of the other connector. The two electrical contacts may engage each other at a mating interface.

As set forth herein, at least one of the two electrical contacts includes a material that increases the impedance of the corresponding electrical contact. This material is hereinafter referred to as an impedance-control material. In some embodiments, the impedance-control material may be selectively placed (e.g., selectively plated) along a mating segment of the electrical contact. The mating segment engages another electrical contact at a mating interface. The impedance-control material may increase the impedance at the mating interface.

In other embodiments, however, the impedance-control material may be disposed along other portions of the electrical contact that coincide with a reduced impedance. For example, the electrical contact may have a retention segment that has an increased cross-sectional area for engaging the housing of the electrical connector. More specifically, the edges of the electrical contact at the retention segment may form an interference fit with a housing of the electrical connector. This increased cross-sectional area of the electrical contact causes a reduction in impedance. Such portions of the electrical contact may also have an impedance-control material disposed thereon to raise the impedance.

Although the illustrated embodiments include electrical connectors that are used in high-speed communication systems, it should be understood that embodiments may be used in other communication systems or in other systems/devices that utilize electrical contacts. Accordingly, the inventive subject matter is not limited to high-speed communication systems.

Electrical contacts described herein include a plurality of different materials. For example, an electrical contact may include a base material, such as copper or copper alloy (e.g., beryllium copper), that is plated or coated with one or more other materials. As used herein, when another material is "plated over" or "coated over" a base material, the other material may directly contact or bond to an outer surface of the base material or may directly contact or bond to an outer surface of an intervening material. More specifically, the other material is not required to be directly adjacent to the base material and may be separated by an intervening layer.

As used herein, the term "relative magnetic permeability" may be referred to in the description as "permeability." As described herein, the different materials of an electrical contact may be selected to control an impedance along the electrical contact. In particular embodiments, the electrical contact includes an impedance-control material or a base material that has a permeability that is, for example, greater than 50. In some embodiments, the permeability is greater than 75 or, more specifically, greater than 100. In certain embodiments, the permeability is greater than 150 or, more specifically, greater than 200. In particular embodiments, the permeability is greater than 250, greater than 350, greater than 450, greater than 550, or more. Non-limiting examples of such materials include nickel, carbon steel, ferrite (nickel zinc or manganese zinc), cobalt, martensitic stainless steel, ferritic stainless steel, iron, or alloys of the same. In some embodiments, the material is a martensitic stainless steel (annealed). For example, the material may be a martensitic stainless steel, Number 1.4006, provided by Lucefine Group (Unified Number System (UNS) S41000).

In some embodiments, the relative magnetic permeability of the designated material (e.g., the impedance-control material or the base material) may be measured at a designated frequency, such as 1 GHz or 5 GHz. For example, the relative magnetic permeability of the material at a designated frequency may be greater than 50. In some embodiments, the relative magnetic permeability of the material at the designated frequency is greater than 100 or, more specifically, greater than 300. In certain embodiments, the relative magnetic permeability of the material at the designated frequency is greater than 500 or, more specifically, greater than 600. In particular embodiments, the relative magnetic permeability is greater than 700, greater than 800, greater than 900, or greater than 1000. In some embodiments, the above values are averages of the relative magnetic permeability between 1-5 GHz. In other embodiments, the above values may be the highest measurement or the lowest measurement of the magnetic permeability between 1-5 GHz. As one example, the material (e.g., the impedance control material or the base material) may have a relative magnetic permeability of 500 or more at 1 GHz.

In some embodiments, the relative magnetic permeability may be determined through industry standards. In some embodiments, the relative magnetic permeability may be provided by the manufacturer or vendor of the material. In some embodiments, the permeability may be tested in a manner that is similar or identical to the methodologies described in Fessant, A., et al. "A broad-band method for measuring the complex permeability of thin soft magnetic films." *Journal of magnetism and magnetic materials* 133.1 (1994): 413-415; Adenot, A-L., et al. "Broadband permeability measurement of ferromagnetic thin films or microwires by a coaxial line perturbation method." *Journal of Applied Physics* 87.9 (2000): 5965-5967; Acher, O., et al. "Permeability measurement on ferromagnetic thin films from 50 MHz up to 18 GHz." *Journal of magnetism and magnetic materials* 136.3 (1994): 269-278; Senda, Masakatsu, and Osamu Ishii. "Permeability measurement in the GHz range for soft-magnetic film using the M/C/M inductance-line." *Magnetics, IEEE Transactions on* 31.2 (1995): 960-965; Ledieu, M., and O. Acher, "New achievements in high-frequency permeability measurements of magnetic materials." *Journal of Magnetism and Magnetic Materials* 258 (2003): 144-150; Acher, O., et al. "Direct measurement of permeability up to 3 GHz of Co—based alloys under tensile stress." *Journal of applied physics* 73.10 (1993): 6162-6164; Acher, Olivier, et al. "Demonstration of anisotropic composites with tunable microwave permeability manufactured from ferromagnetic thin films."*Microwave Theory and Techniques, IEEE Transactions on* 44.5 (1996): 674-684, each of which is incorporated herein by reference in its entirety with respect to the teachings of permeability measurement.

Materials that have a higher permeability provide a higher internal self-inductance. High permeability may also cause shallow skin depths, which increases the effective resistance of the electrical contact at a lower frequency. As a result of the increased inductance and the increased resistance, impedance may be controlled by selectively using permeable materials along designated portions of signal conductors of the electrical connector. As described herein, improved performance can be achieved by either (a) selectively plating a base material with a high permeable material or (b) plating a base material that has a high permeability with a material that has a lower permeability than the base material.

However, it should be understood that magnetic materials, such as those described herein, may lose their magnetic properties as frequency increases in accordance with Snoek's law. Although some materials may lose their permeability at higher frequencies, such as 10 GHz, embodiments that are configured to operate at frequencies less than these higher frequencies may still be effective in controlling impedance. For example, the methods set forth herein may still be applicable for digital signals that have a large baseband, low frequency signal content.

Various embodiments are particularly suitable for communication systems, such as network systems, servers, data centers, and the like, in which the data rates may be greater than four (4) gigabits/second (Gbps) or greater than two (2) gigahertz (GHz). One or more embodiments may be configured to transmit data at a rate of at least about 10 Gbps, at least about 20 Gbps, at least about 28 Gbps, or more. One or more embodiments may be configured to transmit data at a frequency of at least about 2 GHz, at least about 5 GHz, at least about 10 GHz, at least about 20 GHz, at least about 30 GHz or more. In particular embodiments, the electrical connector is configured to operate at a frequency between 0 and 10 GHz. In this context, the term "configured to" does not mean mere capability in a hypothetical or theoretical sense, but means that the embodiment is designed to transmit data at the designated rate or frequency for an extended period of time and at a signal quality that is sufficient for its intended commercial use. It is noted, however, that other embodiments may be configured to operate at data rates that are less than 4 Gbps or operate at frequencies that are less than 2 GHz.

Various embodiments may be configured for certain applications. Non-limiting examples of such applications include host bus adapters (HBAs), redundant arrays of inexpensive disks (RAIDs), workstations, servers, storage racks, high performance computers, or switches. Embodiments may also be configured to be compliant with certain standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard.

For embodiments that include signal pairs, the signal and ground pathways may form multiple sub-arrays. Each sub-array includes, in order, a ground pathway, a signal pathway, a signal pathway, and a ground pathway. This arrangement is referred to as ground-signal-signal-ground (or GSSG) sub-array. The sub-array may be repeated such that an exemplary row of conductors may form G-S-S-G-G-S-S-G-G-S-S-G, wherein two ground pathways are positioned between two adjacent signal pairs. In the illustrated embodiment, however, adjacent signal pairs share a ground conductor such that the pattern forms G-S-S-G-S-S-G-S-S-G. In both examples above, the sub-array may be referred to as a GSSG sub-array. More specifically, the term "GSSG sub-array" includes sub-arrays that share one or more intervening ground conductors.

Other embodiments may be configured for backplane or midplane communication systems. For example, one or more of the electrical connectors described herein may be similar to electrical connectors of the STRADA Whisper or Z-PACK TinMan product lines developed by TE Connectivity. The electrical connectors may include high-density arrays of electrical contacts. A high-density array may have, for example, at least 12 electrical contacts per 100 mm2 along the mating side or the mounting side of the electrical connector. In more particular embodiments, the high-density array may have at least 20 electrical contacts per 100 mm2.

As used herein, phrases such as "a plurality of [elements]" and "an array of [elements]" and the like, when used in the detailed description and claims, do not necessarily include each and every element that a component may have. The component may have other elements that are similar to the plurality of elements. For example, the phrase "a plurality of electrical contacts [being/having a recited feature]" does not necessarily mean that each and every electrical contact of the component has the recited feature. Other electrical contacts may not include the recited feature. Accordingly, unless explicitly stated otherwise (e.g., "each and every electrical contact [being/having a recited feature]"), embodiments may include similar elements that do not have the recited features.

FIG. 1 is a perspective view of a cable assembly 100 including an electrical connector 102, which is hereinafter referred to as a pluggable connector. The cable assembly 100 also includes a circuit board 104 that is communicatively coupled to the pluggable connector 102 and an assembly housing 106 that surrounds the circuit board 104 and is coupled to the pluggable connector 102. A portion of the assembly housing 106 has been removed to reveal the circuit board 104 within a housing cavity 112 defined by the assembly housing 106. The cable assembly 100 also includes a plurality of communication cables 105. In an exemplary embodiment, the communication cables 105 are optical cables, but the communication cables 105 may include electrical conductors in other embodiments. Although not shown, the cable assembly 100 may include an optical/electrical (O/E) converter within the housing cavity 112 that is mounted to the circuit board 104 and converts electrical signals to optical signals and vice versa.

In the illustrated embodiment, the assembly housing 106 includes a pair of housing shells 108, 110 that are coupled to form the housing cavity 112 that receives the circuit board 104. The pluggable connector 102 has a connector body 114 that includes a mating plug 116 and a loading portion 118. The loading portion 118 includes coupling projections 120 that engage the assembly housing 106 to couple the assembly housing 106 to the connector body 114. The mating plug 116 is configured to be inserted into a receptacle assembly (not shown).

For reference, the cable assembly 100 is oriented with respect to mutually perpendicular axes 191, 192, 193, including a mating axis 191, a lateral axis 192, and an elevation axis 193. The mating plug 116 has first and second plug sides 122, 124 that face in opposite directions along the elevation axis 193 and a front edge 126 that joins the first and second plug sides 122, 124. The front edge 126 leads the mating plug 116 into a receiving cavity (not shown) of the receptacle assembly.

Figure 2:
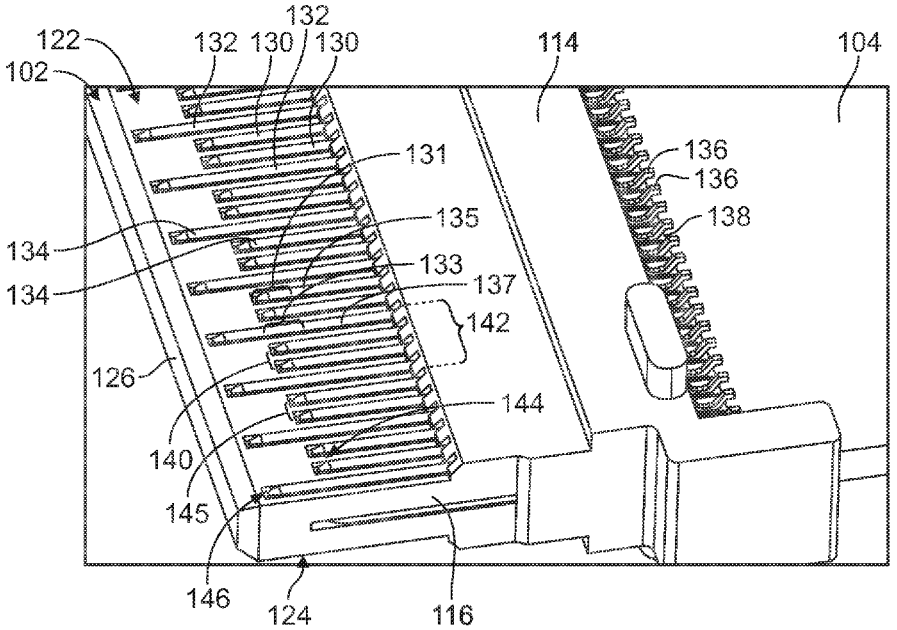
FIG. 2 is an enlarged perspective view of the pluggable connector of FIG. 1 coupled to a circuit board.

FIG. 2 is an enlarged perspective view of a portion of the pluggable connector 102 coupled to the circuit board 104. The pluggable connector 102 includes electrical contacts 130, 132 that are coupled to the connector body 114. The electrical contacts 130, 132 are hereinafter referred to as signal contacts 130 and ground contacts 132, respectively. The signal and ground contacts 130, 132 are positioned along the first and second plug sides 122, 124 of the mating plug 116. More specifically, the signal and ground contacts 130, 132 may be disposed within open-sided channels 144, 146, respectively, that are positioned along the first and second plug sides 122, 124. As such, the signal and ground contacts are exposed alongside the mating plug 114. The signal and ground contacts 130, 132 extend between corresponding mating ends 134 and corresponding terminating ends 136. The mating ends 134 are positioned proximate to the front edge 126 of the connector body 114. As shown, the mating ends 134 of the ground contacts 132 are closer to the front edge 126 than the mating ends 134 of the signal contacts 130.

The signal and ground contacts 130, 132 have mating segments 131, 133, respectively, that represent portions of the signal and ground contacts 130, 132, respectively, that directly engage corresponding contacts of a mating connector (not shown) when data signals are communicated between the mating connector and the pluggable connector 102. As described below, the signal contacts 130 may include a higher permeable material that increases an impedance along the mating segments 131. Optionally, the ground contacts 132 may also include a higher permeable material. In particular embodiments, the signal and ground contacts 130, 132 have a relatively small pitch. For example, a center-to-center spacing 145 between adjacent signal contacts 130 may be less than 1.5 mm. In more particular embodiments, the center-to-center spacing 145 may be less than 1.2 mm, less than 1.0 mm, less than 0.8 mm, or less than 0.6 mm.

The terminating segments 136 of the signal and ground contacts 130, 132 are terminated to contact pads 138 of the circuit board 104. For example, the terminating segments 136 may be mechanically and electrically coupled to the corresponding contact pads 138 through soldering or welding. The contact pads 138 may be electrically coupled to the O/E converter (not shown) or other processing units mounted to the circuit board 104 through traces and/or vias (not shown).

In the illustrated embodiment, the signal and ground contacts 130, 132 are coplanar and include elongated bodies 135, 137, respectively, that have similar sizes and shapes. For example, the signal and ground contacts 130, 132 may have similar cross-sectional dimensions (e.g., thickness and width). In other embodiments, however, the ground contacts 132 may be ground blades in which the ground blades have substantially greater widths or thicknesses than the signal contacts and extend a depth into the mating plug 116. Such ground blades may have outer edges that are interleaved between the signal contacts 132 and are configured to engage corresponding contacts of the receptacle assembly (not shown).

In the illustrated embodiment, the signal contacts 130 are arranged to form signal pairs 140. The ground contacts 132 are interleaved between the signal pairs 140. As shown, the signal and ground contacts 130, 132 are arranged in a repeating pattern such that a single ground contact 132 is interleaved between two signal pairs 140. In other embodiments, the signal and ground contacts 130, 132 are arranged in a repeating pattern such that two ground contacts 132 are interleaved between two signal pairs 140. In either of the above examples, the signal and ground contacts 130, 132 may form GSSG sub-arrays 142 in which each signal pair 140 is flanked on both sides by one or more ground contacts 132. In alternative embodiments, the signal contacts 130 may not be arranged in signal pairs 140.

Figure 3:
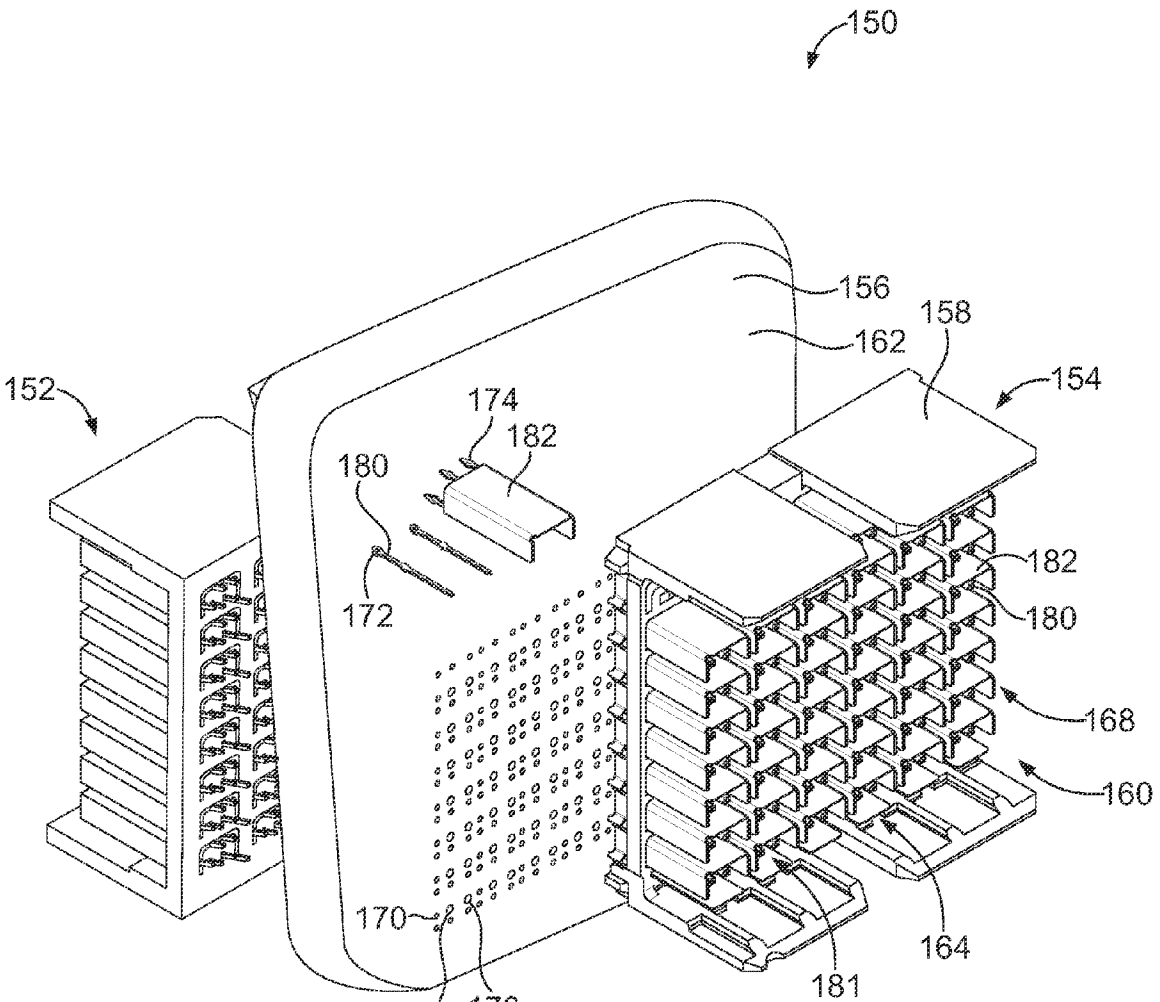
FIG. 3 is an exploded view of a circuit board assembly formed in accordance with an embodiment.

FIG. 3 is a partially exploded view of a circuit board assembly 150 that includes a circuit board 156 and first and second header connectors 152, 154 positioned for mounting to the circuit board 156. The circuit board assembly 150 may be used in backplane communication systems. Although the following description is with respect to the second header connector 154, the description is also applicable to the first header connector 152. As shown, the header connector 154 includes a connector body 158 having a front end 160 that faces away from a board side 162 of the circuit board 156. The connector body 158 defines a housing cavity 164 that opens to the front end 160 and is configured to receive a receptacle connector (not shown) when the receptacle connector is advanced into the housing cavity 164.

As shown, the second header connector 154 includes a contact array 168 that has electrical contacts 180, 182, which include signal contacts 180 and ground shields 182. The contact array 168 may include multiple signal pairs 181 in which each signal pair 181 is surrounded by a ground shield 182. As described below, the signal contacts 180 may include a higher permeable material that increases an impedance along designated segments of the signal contacts 180.

The circuit board 156 includes conductive vias 170 that open along the board side 162 and extend into the circuit board 156. In an exemplary embodiment, the conductive vias 170 extend entirely through the circuit board 156. In other embodiments, the conductive vias 170 extend only partially through the circuit board 156. The conductive vias 170 are configured to receive the signal contacts 180 of the first and second header connectors 152, 154. For example, the signal contacts 180 include compliant pins 172 that are configured to be loaded into corresponding conductive vias 170. The compliant pins 172 mechanically engage and electrically couple to the conductive vias 170. Likewise, at least some of the conductive vias 170 are configured to receive compliant pins 174 of the ground shields 182. The compliant pins 174 mechanically engage and electrically couple to the conductive vias 170. The conductive vias 170 that receive the ground shields 182 may surround the pair of conductive vias 170 that receive the corresponding pair of electrical contacts 120. The ground shields 182 are C-shaped and provide shielding on three sides of the signal pair 181.

Figure 4:
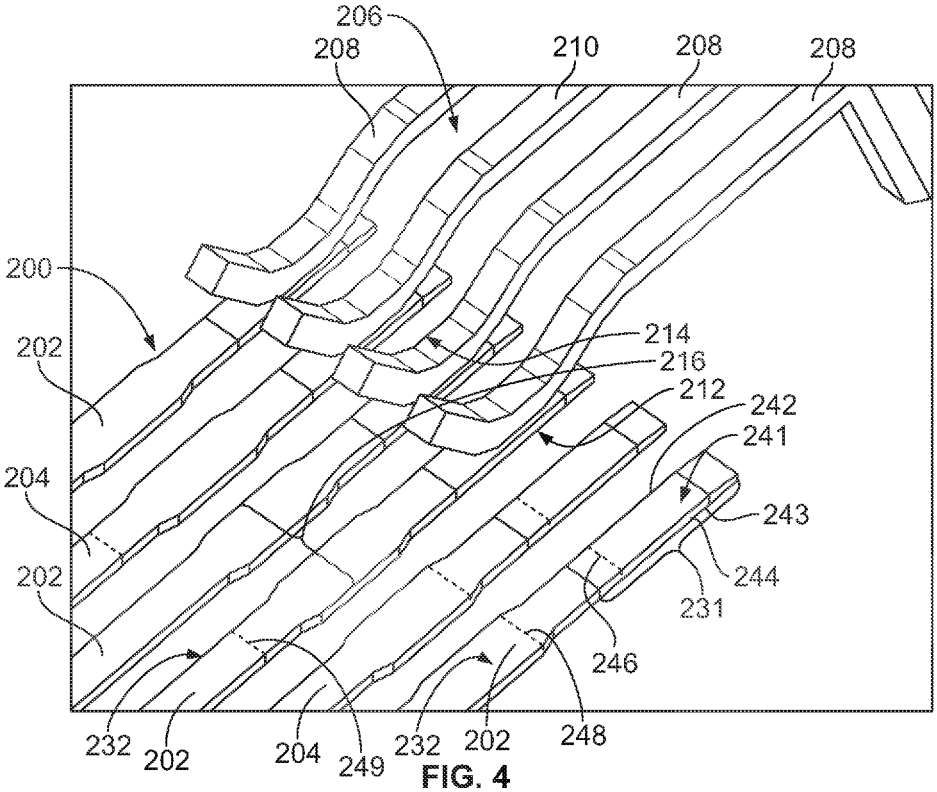
FIG. 4 is an enlarged view of plug contacts and receptacle contacts engaging each other at respective mating interfaces. Two of the receptacle contacts have been removed to illustrate the plug contacts in greater detail.

FIG. 4 is an enlarged view of an array 200 of plug contacts 202, 204 and an array 206 of receptacle contacts 208, 210. The array 200 may be part of a pluggable connector, such as the pluggable connector 102 (FIG. 1). The array 206 may be part of a receptacle assembly (not shown) that is configured to mate with the pluggable connector. In alternative embodiments, the plug contacts 202, 204 may form part of a header connector, such as the header connectors 152 and 154 (FIG. 3). For illustrative purposes, only a portion of the arrays 200, 206 are shown.

The plug contacts 202, 204 include signal contacts 202 and ground contacts 204. The receptacle contacts 208, 210 include signal contacts 208 and ground contacts 210. Each signal contact 202 engages a respective signal contact 208 at a corresponding mating interface 212. As described above, the mating interface 212 coincides has a relatively low impedance relative to other portions of the signal pathway. This impedance is based, at least in part, on the dimensions of the signal contact 202, 208 at the mating interface 212. Each ground contact 204 engages a respective ground contact 210 at a corresponding mating interface 214.

The signal and ground contacts 202, 204 are coplanar and are patterned or ordered such that the array 200 constitutes a GSSG sub-array. More specifically, the signal contacts 202 form signal pairs 216, and at least some of the ground contacts 204 are interleaved between adjacent signal pairs 216. In other embodiments, at least two ground contacts 204 are interleaved between adjacent signal pairs 216.

Figure 5:
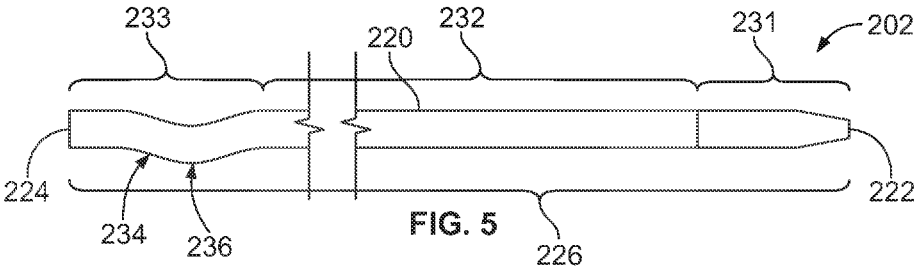
FIG. 5 is a side view of one of the plug contacts of FIG. 4.

FIG. 5 illustrates a side view of an exemplary signal contact 202. Although the following description is generally directed toward one of the signal contacts 202, it should be understood that other signal contacts 202 may have similar or identical features. Moreover, the ground contacts 204 (FIG. 4) may be similar or identical to the signal contact 202 in FIG. 5. The signal contact 202 includes an elongated body 220 that extends between a mating or leading end 222 and a terminating or trailing end 224. The elongated body 220 has a length 226 that is measured between the mating end 222 and the terminating end 224. In an exemplary embodiment, the signal contact 202 and the ground contact 204 have identical lengths 226.

In other embodiments, however, the signal contact 202 and the ground contact 204 (FIG. 4) may have different lengths. For example, the ground contact 204 may be longer than the signal contact 202 such that the mating end of the ground contact 204 is located in front of the mating end 222 of the signal contact 202. In such embodiments, the ground contacts 204 may engage the corresponding ground contacts 210 (FIG. 4) prior to the signal contacts 202 engaging the signal contacts 208 (FIG. 4).

The elongated body 220 is formed from a series of segments 231, 232, 233. The segment 231 is hereinafter referred to as the mating segment 231, the segment 232 is hereinafter referred to as a body or intermediate segment 232, and the segment 233 is hereinafter referred to as the terminating segment 233. As described below, the mating segment 231 corresponds to a portion of the elongated body 220 that has an impedance-control material 252 (shown in FIG. 6) plated over a base material 250 (shown in FIG. 6).

The body segment 232 extends between the mating segment 231 and the terminating segment 233. The terminating segment 233 corresponds to structural changes in the elongated body 220 that facilitate terminating the signal contact 202 to an electrical component. For example, the terminating segment 233 has a bottom surface 234 that curves from the body segment 232 to an inflection point 236 and then curves away from the inflection point 236 toward the terminating end 224. The inflection point 236 is configured to engage a contact pad of a circuit board (not shown), such as the circuit board 104 (FIG. 1). In alternative embodiments, the terminating segment 233 is a compliant pin (e.g., eye-of-needle pin) that is configured to be inserted into a plated thru-hole (PTH) of a circuit board (not shown), such as the circuit board 156 (FIG. 3).

Returning to FIG. 4, the mating segment 231 has one mating surface 241 and three non-mating surfaces 242, 243, 244. The mating surface 241 is configured to directly engage the signal contact 208. The non-mating surfaces 242-244 may interface with or engage a connector body (not shown), such as the connector body 114 (FIG. 1). Also shown in FIG. 4, the mating segment 231 has a cross-section 246, and the body segment 232 includes a first cross-section 248 and a second cross-section 249. In some embodiments, the cross-section 246 of the mating segment 231 is greater than each of the first and second cross-sections 248, 249 of the body segment 232. The cross-section 246 may also be greater than a cross-section (not shown) of the terminating segment 233. In some embodiments, the cross-section of the terminating segment 233 is identical to the size and shape of the second cross-section 249.

Figure 6:
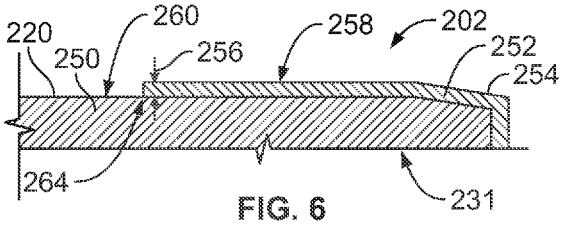
FIG. 6 is a cross-section of a portion of one of the plug contacts shown in FIG. 4 that includes a base material and an impedance-control material that is plated over the base material.

FIG. 6 is a cross-section of a portion of the signal contact 202. The elongated body 220 of the signal contact 202 includes the base material 250 and the impedance-control material 252. The impedance-control material 252 is plated or coated over the base material 250. In the illustrated embodiment, the impedance-control material 252 is plated directly onto an outer surface 260 of the base material 250. In other embodiments, however, one or more intervening layers may be plated onto the base material 250 and the impedance-control material 252 may be subsequently plated over the intervening layer(s) and, consequently, over the base material 250. By way of example, the impedance-control material 252 may be plated over the base material 250 using an electroplating process, an electro-less plating process, or a physical vapor deposition (PVD) process. It should be understood that other processes of plating the impedance-control material 252 over the base material 250 may be used.

The impedance-control material 252 forms a control layer 254. A thickness 256 of the control layer 254 may be measured from an outer surface 258 of the control layer 254 to the outer surface 260 of the base material 250 or the intervening layer. For illustrative purposes, the thickness 256 of the control layer 254 has been enlarged such that an identifiable discontinuity 264 is formed between the outer surface 258 and the outer surface 260. It should be understood that the discontinuity 264 may not be readily identifiable by visually inspecting the signal contact 202 in some embodiments. For example, the thickness 256 of the control layer 254 may be between 10 microinches (or 254 nm) and 200 microinches (or 5080 nm). In some embodiments, the thickness of the control layer 254 may be between 20 microinches (or 50.8 nm) and 100 microinches (or about 2540 nm).

As shown in FIG. 6, the impedance-control material 252 extends along only a portion of the elongated body 220 to form the mating segment 231. The mating segment 231 is configured to engage a corresponding contact of a mating connector (not shown). The impedance-control material 252 has a relative magnetic permeability that is greater than a relative magnetic permeability of the base material 250. The base material 250 may be, for example, copper or a copper alloy (e.g., beryllium copper). The base material 250 may be stamped and formed from a sheet of material.

The impedance-control material 252 may be selected in order to achieve an increase or rise in the impedance of the signal contact 202 along the mating segment 231. The impedance-control material 252 may comprise a ferromagnetic metal or metal alloy. For example, the impedance-control material 252 may comprise nickel, cobalt, or stainless steel. The relative magnetic permeability of the impedance-control material 252 is greater than 50. In some embodiments, the relative magnetic permeability of the impedance-control material 252 is greater than 100. In certain embodiments, the relative magnetic permeability of the impedance-control material 252 is greater than 150 or greater than 200. In some embodiments, the relative magnetic permeability of the impedance-control material 252 is less than 500.

It is noted that the mating segments 231 do not include a precious metal material to facilitate establishing an electrical connection between the signal contact 202 and the corresponding signal contact 208 (FIG. 4). In such embodiments, the signal contacts 208 may be configured to apply a substantial normal force against the signal contact 202 at the respective mating interface 212. However, in other embodiments, a precious metal material may be plated over at least a portion of the mating segment 231. In such embodiments, the signal contact 202 may be similar to an electrical contact 302 that is shown in FIG. 7.

Figure 7:
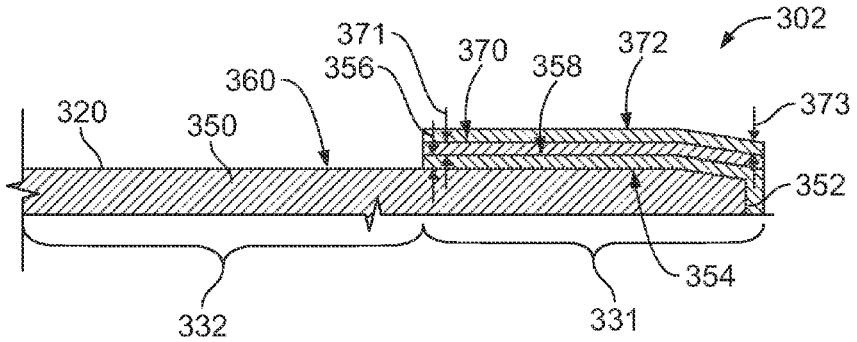
FIG. 7 is a cross-section of a portion of an exemplary plug contact that includes a base material, an impedance-control material that is plated over the base material, and a precious metal material that is plated over the impedance-control material.

FIG. 7 is a cross-section of a portion of an exemplary signal contact 302. The signal contact 302 may be, for example, a plug contact of a pluggable connector (not shown), such as the pluggable connector 102 (FIG. 1). The signal contact 302 may also form part of a header connector (not shown), such as the header connectors 152, 154 (FIG. 3). For illustrative purposes, thicknesses of different layers of the signal contact 302 in FIG. 7 have been enlarged.

The signal contact 302 may include features that are similar to features of the signal contact 202 (FIG. 4). For example, the signal contact 302 includes an elongated body 320. The elongated body 320 has a mating segment 331 and a body segment 332 and may include a terminating segment (not shown). The elongated body 320 includes a base material 350 that may be similar or identical to the base material 250 (FIG. 6) and an impedance-control material 352 that may be similar or identical to the impedance-control material 252 (FIG. 6). As shown, the impedance-control material 352 is plated or coated over the base material 350 and forms a control layer 354.

In the illustrated embodiment, the impedance-control material 352 is plated directly onto an outer surface 360 of the base material 350. In other embodiments, however, one or more intervening layers may be plated onto the base material 350 and the impedance-control material 352 may be subsequently plated over the intervening layer(s). The control layer 354 has a thickness 356 that is measured from an outer surface 358 of the control layer 354 to the outer surface 360 of the base material 350 (or the intervening layer if an intervening layer exists). The thickness 356 of the control layer 354 may be similar to the thickness 256 (FIG. 6) of the control layer 254 (FIG. 6).

Additional layers may be applied to the mating segment 331. For example, a barrier material 370 may be plated over the mating segment 331 and a precious metal material 372 may be plated over the barrier material 370. The barrier material 370 may include, for example, nickel and/or tin and function as a diffusion barrier between the impedance-control material 352 and the precious metal material 372. The precious metal material 372 may include, for example, gold, gold alloy, palladium, palladium alloy, silver, or silver alloy. The precious metal material 370 may be plated at least partially over the mating segment 331.

The barrier material 370 has a thickness 371, and the precious metal material 372 has a thickness 373. The thickness 371 may be, for example, between 10 microinches (or 254 nm) and 200 microinches (or 5080 nm). In some embodiments, the thickness 371 may be between 20 microinches (or 50.8 nm) and 100 microinches (or about 2540 nm). The thickness 373 may be, for example, between 2 and 10 microinches (or between 50.8 nm and 254 nm). The thickness 373 may be, for example, between 2 and 30 microinches (or between 50.8 nm and 762 nm). In some embodiments, the precious metal material 372 may be characterized as forming a flash layer.

As described herein, the impedance-control material 352 may have a relative magnetic permeability that is greater than a relative magnetic permeability of the base material 350 and the precious metal material 372. In some embodiments, the impedance-control material 352 may have a relative magnetic permeability that is greater than a relative magnetic permeability of the barrier material 370. The relative magnetic permeability of the impedance-control material 352 may be greater than 50, greater than 100, greater than 150, or greater than 200. In some embodiments, the relative magnetic permeability of the impedance-control material 352 is less than 500.

Figure 8:
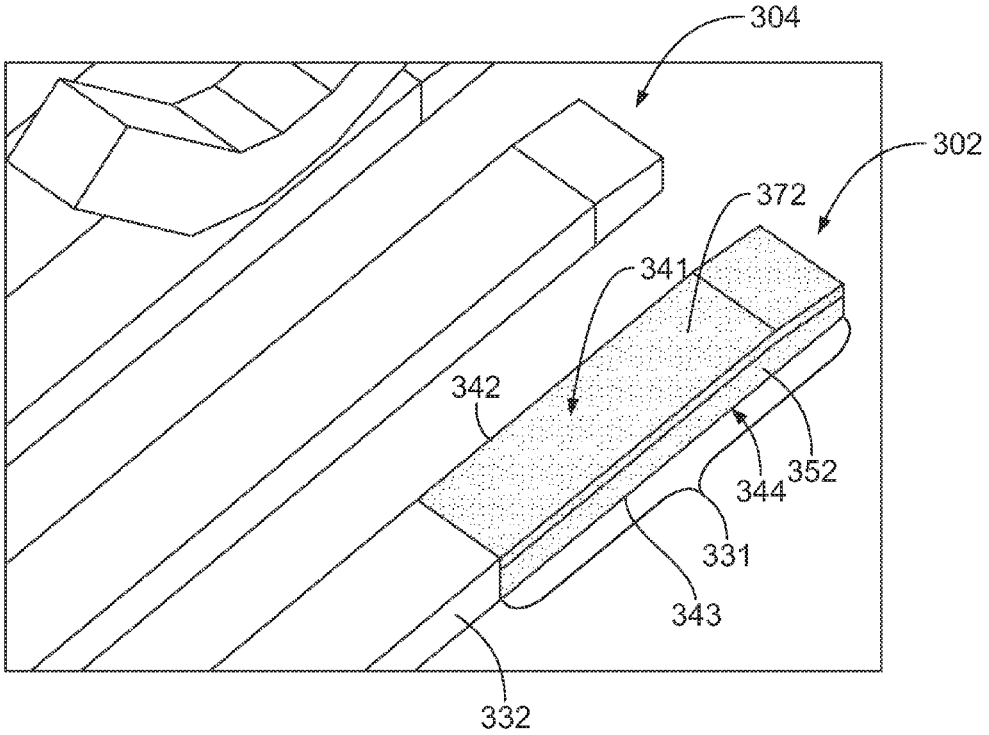
FIG. 8 is an enlarged view of two plug contacts, including the plug contact of FIG. 7.

FIG. 8 is an enlarged perspective view of the signal contact 302 and an adjacent ground contact 304. The ground contact 304 may be similar or identical to the signal contact 302. The signal and ground contacts 302, 304 may form a portion of an array, such as the array 200 (FIG. 4). The mating segment 331 and a portion of the body segment 332 are shown in FIG. 8.

In some embodiments, the barrier material 370 (FIG. 7) and the precious metal material 372 are selectively placed (e.g., selectively plated) along the mating segment 331 such that a portion of the impedance-control material 352 is exposed to an exterior of the signal contact 202. More specifically, the mating segment 331 includes a mating surface 341 and non-mating surfaces 342, 343, 344. The mating surface 341 is configured to directly engage a signal contact (not shown) of a mating connector (not shown). The mating surface 341 and each of the non-mating surfaces 342-344 face in respective different directions. In the illustrated embodiment, the mating surface 341 is an exterior surface that is defined by the precious metal material 372, and the non-mating surfaces 342-344 are essentially defined by the impedance-control material 352. Such embodiments may enable sufficient electrical contact between the mating surface 341 and the corresponding signal contact (not shown) and simultaneously increase impedance along the mating segment 331.

Figure 9:
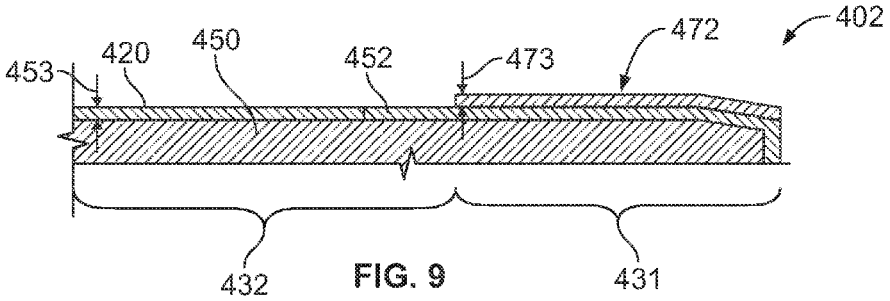
FIG. 9 is a cross-section of a portion of an exemplary plug contact that includes a base material having a high relative magnetic permeability, a barrier material that is plated over the base material, and a precious metal material that is plated over the barrier material.

FIG. 9 is a cross-section of a portion of an exemplary signal contact 402. The signal contact 402 may be, for example, a plug contact of a pluggable connector (not shown), such as the pluggable connector 102 (FIG. 1). The signal contact 402 may also form part of a header connector (not shown), such as the header connectors 152, 154 (FIG. 3). The signal contact 402 may include features that are similar to features of the signal contact 202 (FIG. 4). For example, the signal contact 402 includes an elongated body 420. The elongated body 420 has a mating segment 431 and a body segment 432 and may include a terminating segment (not shown). The elongated body 420 includes a base material 450 and a barrier material 452. The barrier material 452 may be plated over a majority of the base material 450. Optionally, a precious metal material 472 may be plated over the barrier material 452.

The precious metal material 472 may include, for example, gold, gold alloy, palladium, palladium alloy, silver, or silver alloy. The barrier material 452 may have a thickness 453, and the precious metal material 472 may have a thickness 473. By way of example, the thickness 452 may be, for example, between 10 microinches (or 254 nm) and 200 microinches (or 5080 nm). In some embodiments, the thickness 452 may be between 20 microinches (or 50.8 nm) and 100 microinches (or about 2540 nm). The thickness 473 may be, for example, between 2 and 30 microinches (or between 50.8 nm and 762 nm). In particular embodiments, the thickness 473 may be between 2 and 10 microinches (or between 50.8 nm and 254 nm). In some embodiments, the precious metal material 472 may be characterized as forming a flash layer.

In an exemplary embodiment, the base material 450 has a high relative magnetic permeability. For example, the base material 450 may have a relative magnetic permeability that is greater than a relative magnetic permeability of the barrier material 452 and greater than a relative magnetic permeability of the precious metal material 472. The relative magnetic permeability of the base material 450 may be greater than 50, greater than 100, greater than 150, or greater than 200. In some embodiments, the relative magnetic permeability of the base material 450 is less than 500.

Figure 10:
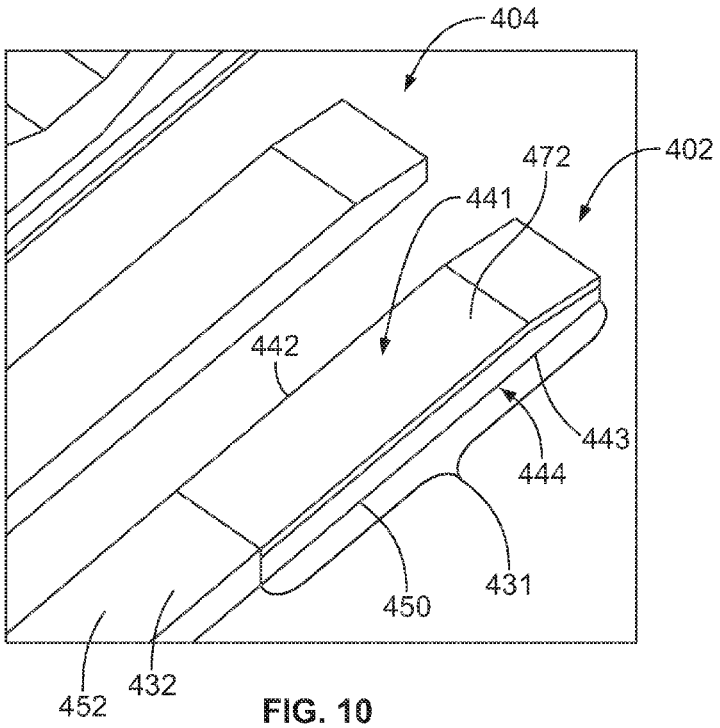
FIG. 10 is an enlarged view of two plug contacts, including the plug contact of FIG. 9.

FIG. 10 is an enlarged perspective view of the signal contact 402 and an adjacent ground contact 404. The ground contact 404 may be similar or identical to the signal contact 402. The signal and ground contacts 402, 404 may form a portion of an array, such as the array 200 (FIG. 4). The mating segment 431 and a portion of the body segment 432 are shown in FIG. 10.

The mating segment 431 includes a mating surface 441 and non-mating surfaces 442, 443, 444. The mating surface 441 is configured to directly engage a signal contact (not shown) of a mating connector (not shown). The mating surface 441 and each of the non-mating surfaces 442-444 face in respective different directions. In the illustrated embodiment, the mating surface 441 is an exterior surface that is defined by the precious metal material 472, and the non-mating surfaces 442-444 are essentially defined by the base material 450. More specifically, the barrier layer 452 may be selectively placed such that the barrier layer 452 is plated over the base material 450 along the body segment 432, but does not exist along the non-mating surfaces 442-444 of the mating segment 431. Such embodiments may enable sufficient electrical contact between the mating surface 441 and the corresponding signal contact (not shown) and simultaneously increase impedance along the mating segment 431. As shown in FIG. 9, however, the barrier layer 452 may be disposed between the precious metal material 472 and the base material 450 and function as a diffusion barrier between the precious metal material 472 and the base material 450.

For embodiments that utilize the barrier layer 452, the high-frequency fields and surface currents may only exist (or primarily exist) in the barrier layer 452 along the body segment 432 because the barrier layer 452 may be less permeable and lossy than the base material 450. Accordingly, the high-speed signals travel through the barrier layer 452. If the barrier layer 452 exists for a substantial portion of the length of the signal contact 402, such as a majority of the length, losses may be reduced.

Figure 11:
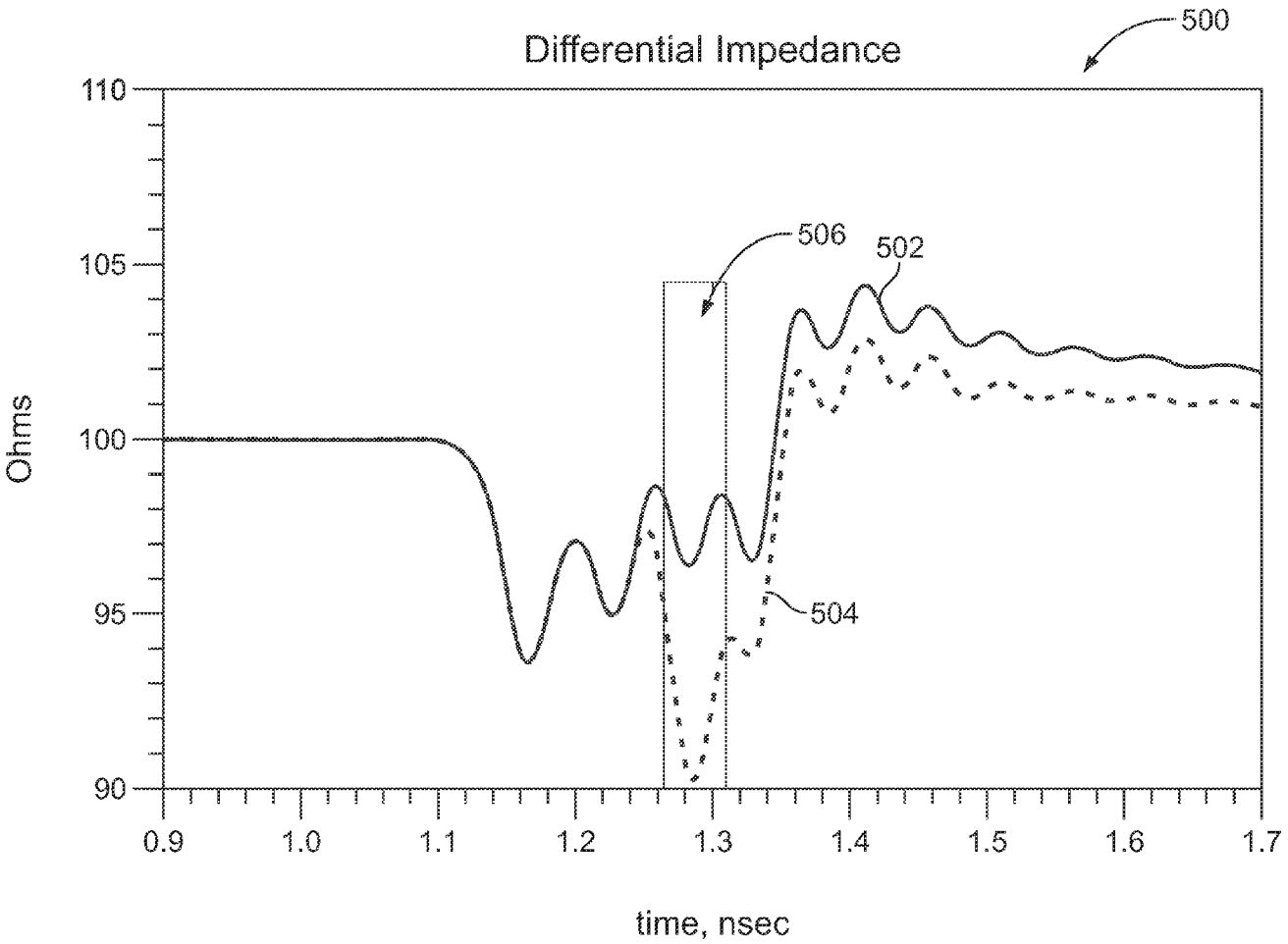
FIG. 11 includes a graph that illustrates a differential impedance between a conductive pathway formed in accordance with an embodiment and a conventional conductive pathway.
Figure 12:
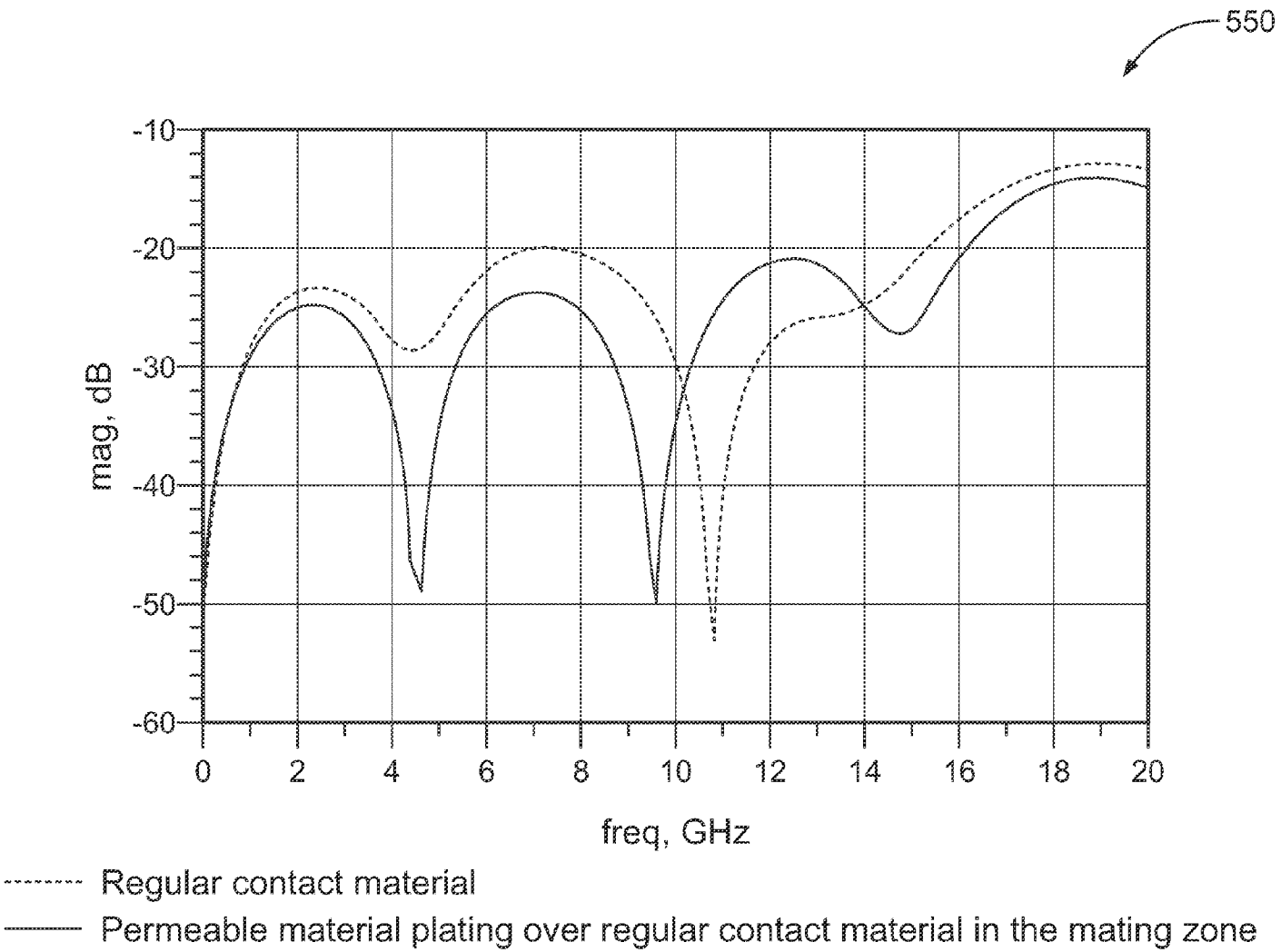
FIG. 12 includes a graph 550 illustrates differential return loss in a mating zone between a conventional mating interface and a mating interface that includes an impedance-control material disposed thereon.

FIG. 11 includes a graph 500 that illustrates a differential impedance between a conductive pathway 502 formed in accordance with an embodiment and a conventional conductive pathway 504. The conductive pathway 502 has a high relative magnetic permeability plating along a mating zone 506 between two signal contacts. The mating zone 506 generally occurs between 1.27 nsec and 1.31 nsec along the conductive pathways 502, 504. The conventional conductive pathway 504, however, does not have a high relative magnetic permeability plating along the mating zone 506. As shown, the impedance along the mating zone 506 of the conductive pathway 502 has increased relative to the impedance along the mating zone 506 of the conventional conductive pathway 504. In some embodiments, the impedance along the mating zone 506 is at least 3% greater than an impedance of the conventional conductive pathway 504 that is devoid of the high relative magnetic permeability plating along the mating segment 506. For example, the impedance along the mating zone 506 increased from about 90.5 ohms to about 96.5 ohms, which is about 6 ohms. FIG. 12 includes a graph 550 that illustrates differential return loss in a mating zone between a conventional mating interface and a mating interface that includes the impedance-control material disposed thereon. As shown, the return loss improved by 5 dB (−21.2 dB vs. −26.d dB) at 12.5 GHz (fundamental frequency of 25 Gb/s data rate).

Figure 13:
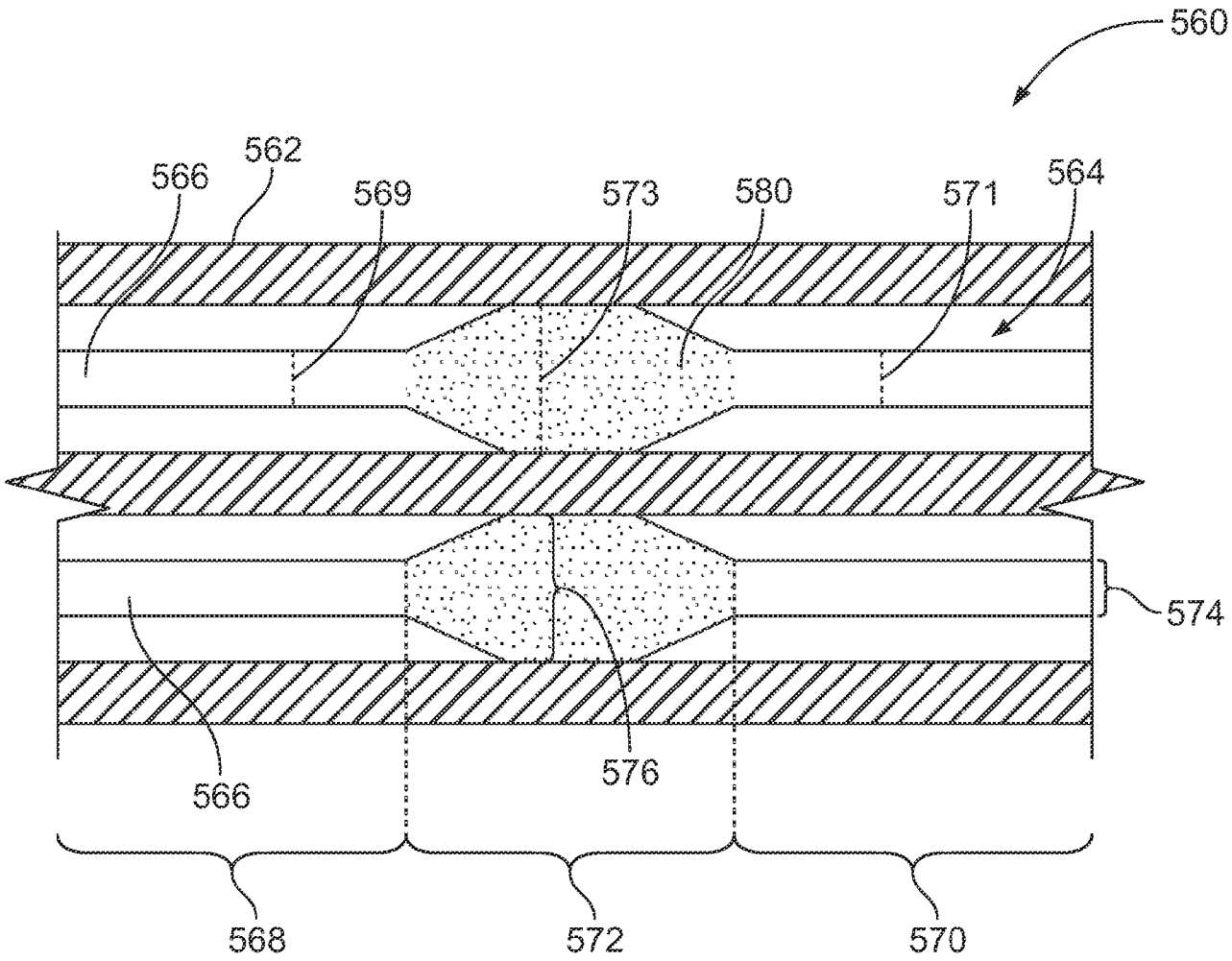
FIG. 13 is a cross-sectional view of a portion of an electrical connector in accordance with an embodiment.

FIG. 13 is a cross-sectional view of a portion of an electrical connector 560 in accordance with an embodiment. The electrical connector 560 includes a connector housing 562 having a plurality of elongated channels 564 and electrical contacts 566 disposed therein. The electrical contacts 566 may be, for example, signal conductors that extend between different mating interfaces (not shown) of the electrical connector 560. For example, the electrical connector 560 may be similar or identical to the electrical connector 102 (FIG. 1). The electrical contacts 566 may include mating segments at one or both ends, such as the mating segments described above.

The electrical contacts 566 include body segments 568, 570 and retention segments 572 that extend between and join the corresponding body segments 568, 570. The body segments 568, 570 have a width 574 and a thickness (not shown) that extends into and out of the page in FIG. 13. The retention segments 572 have a width 576 and a thickness (not shown) that extends into and out of the page. As shown, the width of each retention segment 572 increases from the width 574 to the width 576. The retention segments 572 have a cross-section 573, and the body segments 568, 570 have respective cross-sections 569, 571. The cross-section 573 has a greater area than the cross-sections 569, 571. For example, the thicknesses may be the same, but the width 576 is greater than the width 574. The cross-sections 573 are sized and shaped to engage interior surfaces of the connector housing 562 that define the channels 564.

As shown, the electrical contacts 566 have an impedance-control material 580 that is disposed along the corresponding retention segments 572. The impedance-control material 580 effectively increases the impedance of the electrical contacts 566 along the retention segments 572. The impedance-control material 580 may be disposed along the retention segments 572 using an electroplating process, an electro-less plating process, a PVD process, or other process.

As described herein, embodiments may include impedance-control material along one or more designated portions of the electrical contact(s). The impedance-control material effectively increases the impedance of the electrical contact at the designated portion. For example, the impedance-control material may be disposed along a mating segment or a retention segment. It should be understood that the mating and retention segments are just examples and that the impedance-control material may be disposed along any designated portion of the electrical contact that coincides with a reduced impedance.

It is to be understood that the above description is intended to be illustrative, and not restrictive. Moreover, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a connector body; and a plurality of electrical contacts coupled to the connector body, each of the electrical contacts having an elongated body that includes a base material and an impedance-control material that is disposed over the base material, the base material of the elongated body having an outer surface, the impedance-control material being selectively plated onto only a portion of the outer surface such that the impedance-control material extends along only a designated portion of a length of the elongated body, the length being a greatest dimension of the elongated body, wherein the impedance-control material has a relative magnetic permeability that is greater than a relative magnetic permeability of the base material, the impedance-control material increasing the impedance of the electrical contact, wherein the designated portion forms a mating segment that is configured to engage a corresponding contact of a mating connector.

2. The electrical connector of claim 1, wherein the relative magnetic permeability of the impedance-control material at 1 GHz is greater than 50.

3. The electrical connector of claim 1, wherein the relative magnetic permeability of the impedance-control material at 1 GHz is greater than 500.

4. The electrical connector of claim 1, wherein the impedance along the designated portion is at least 3% greater than an impedance of an electrical contact that is devoid of the impedance-control material along the designated portion.

5. The electrical connector of claim 1, wherein each of the electrical contacts further comprises a precious metal material that is selectively placed over only a portion of the mating segment.

6. The electrical connector of claim 5, wherein the mating segment includes a mating surface and non-mating surfaces that face in respective different directions, the mating surface including the precious metal material, the non-mating surfaces including the impedance-control material.

7. The electrical connector of claim 1, wherein the electrical connector is configured to operate at a frequency of up 30 GHz.

8. The electrical connector of claim 1, wherein the electrical contacts are signal contacts and the electrical connector further comprises a plurality of ground contacts, the signal and ground contacts being coplanar and forming a ground-signal-signal-ground array.

9. The electrical connector of claim 8, wherein a center-to-center spacing between adjacent signal contacts is less than 1.5 millimeters.

10. The electrical connector of claim 1, wherein the electrical connector is configured to removably engage the mating connector, the mating segment being exposed, when the electrical and mating connectors are unengaged, to an exterior space prior to the electrical connector and the mating connector engaging each other.

11. The electrical connector of claim 10, wherein the electrical connector is configured to transmit data signals through the plurality of electrical contacts at data rates that are greater than two gigahertz (GHz).

12. An electrical connector comprising:

a connector body; and a plurality of electrical contacts coupled to the connector body, each of the electrical contacts having an elongated body that includes a base material and an impedance-control material that is disposed over the base material, the impedance-control material extending along only a designated portion of the elongated body, wherein the impedance-control material has a relative magnetic permeability that is greater than a relative magnetic permeability of the base material, the impedance-control material increasing the impedance of the electrical contact;

wherein the electrical contacts are signal contacts and the electrical connector further comprises a plurality of ground contacts, the signal and ground contacts being coplanar and forming a ground-signal-signal-ground array, and wherein the connector body includes a mating plug that is configured to be inserted into a receptacle assembly, the signal and ground contacts being exposed alongside the mating plug.

13. An electrical contact comprising an elongated body that includes a base material and an impedance-control material disposed over the base material, the base material of the elongated body having an outer surface, the impedance-control material being selectively plated onto only a portion of the outer surface such that the impedance-control material extends along only a designated portion of a length of the elongated body, the length being a greatest dimension of the elongated body, wherein the impedance-control material has a relative magnetic permeability that is greater than a relative magnetic permeability of the base material, the impedance-control material increasing an impedance of the electrical contact, wherein the designated portion forms a mating segment that is configured to engage a corresponding contact of a mating connector.

14. The electrical contact of claim 13, wherein the relative magnetic permeability of the impedance-control material is greater than 50.

15. The electrical contact of claim 13, wherein the relative magnetic permeability of the impedance-control material at 1 GHz is greater than 500.

16. The electrical contact of claim 13, wherein the impedance along the designated portion is at least 3% greater than an impedance of an electrical contact that is devoid of the impedance-control material along the designated portion.

17. The electrical contact of claim 13, wherein the electrical contact further comprises a precious metal material that is selectively placed over only a portion of the mating segment, the precious metal material comprising gold, gold alloy, palladium, palladium alloy, silver, or silver alloy.

18. The electrical contact of claim 13, wherein the mating segment includes a mating surface and non-mating surfaces that face in respective different directions, the mating surface including the precious metal material, the non-mating surfaces including the impedance-control material.

19. An electrical connector comprising:

a connector body; and a plurality of electrical contacts coupled to the connector body, each of the electrical contacts having an elongated body that includes a base material and an impedance-control material that is disposed over the base material, the base material of the elongated body having an outer surface, the impedance-control material being selectively plated onto only a portion of the outer surface such that the impedance-control material extends along only a designated portion of a length of the elongated body, the length being a greatest dimension of the elongated body, wherein the impedance-control material has a relative magnetic permeability that is greater than a relative magnetic permeability of the base material, the impedance-control material increasing the impedance of the electrical contact, wherein each of the electrical contacts includes body segments and a retention segment that extends between and joins the body segments, the retention segment and the body segments having different cross-sectional areas, the retention segment engaging an interior surface of the connector body to form an interference fit therewith, the retention segment including the impedance-control material.

20. The electrical connector of claim 19, wherein the electrical connector is configured to transmit data signals through the plurality of electrical contacts at data rates that are greater than two gigahertz (GHz).

* * * * *